US007258257B2

(12) United States Patent
Sebel

(10) Patent No.: US 7,258,257 B2
(45) Date of Patent: Aug. 21, 2007

(54) GARMENT HANGER

(76) Inventor: Harry Sebel, 23 Yarranabbe Road, Darling Point, Sydney, New South Wales (AU) 2027

( * ) Notice: Subject to any disclaimer, the term of this patent is extended or adjusted under 35 U.S.C. 154(b) by 366 days.

(21) Appl. No.: 10/499,846

(22) PCT Filed: Jan. 9, 2003

(86) PCT No.: PCT/AU03/00020

§ 371 (c)(1),
(2), (4) Date: Jun. 23, 2004

(87) PCT Pub. No.: WO03/056982

PCT Pub. Date: Jul. 17, 2003

(65) Prior Publication Data

US 2005/0178806 A1 Aug. 18, 2005

(30) Foreign Application Priority Data

Jan. 14, 2002 (AU) ..... PR9951
Jul. 18, 2002 (AU) ..... 2002950244

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 3,593,897 | A * | 7/1971 | Knox | 223/96 |
| 4,582,233 | A | 4/1986 | Brickhouse | |
| 4,892,238 | A * | 1/1990 | Pinczowski | 223/92 |
| D354,857 | S * | 1/1995 | Hammer | D6/318 |
| 5,836,487 | A * | 11/1998 | Lam | 223/94 |
| 6,036,062 | A * | 3/2000 | von Fabris auf Mayerhofen | 223/85 |
| 6,983,961 | B2 * | 1/2006 | Aduana et al. | 289/17 |

FOREIGN PATENT DOCUMENTS

| | | |
|---|---|---|
| EP | 1090571 A | 4/2001 |
| GB | 2308294 A | 6/1997 |

* cited by examiner

*Primary Examiner*—Shaun R. Hurley
(74) *Attorney, Agent, or Firm*—David A. Guerra

(57) ABSTRACT

A garment hanger adapted for hooking over a clothes rail. The garment hanger having a hanger frame for supporting a garment, a hanger support hook adjacent an apex of the frame, and a handle portion depending downwards from an end of the frame. The frame being generally perpendicular to a notional vertical plane containing the clothes rail. The end being offset downwardly from the apex and laterally of the notional vertical plane. The handle portion has a handle positioned substantially directly below the end for use by a user for more easily handling the hanger when it is loaded with one or more garments.

22 Claims, 10 Drawing Sheets

GARMENT HANGER

CROSS-REFERENCE TO RELATED APPLICATIONS

This application is an U.S. national phase application under 35 U.S.C. §371 based upon co-pending International Application No. PCT/AU03/00020 filed Jan. 9, 2003. Additionally, this U.S. national phase application claims the benefit of priority of co-pending International Application No. PCT/AU03/00020 filed Jan. 9, 2003, Australian Application No. PR 9951 filed on Jan. 14, 2002, and Australian Application No. AU 2002950244 filed Jul. 18, 2002. The entire disclosures of the prior applications are incorporated herein by reference. The international application was published Jul. 17, 2003 under Publication No. WO 03/056982 A1.

BACKGROUND OF THE INVENTION

1. Field of the Invention

The present invention relates to a garment hanger designed for easier usage by many different types of users.

2. Description of the Prior Art

Conventionally, a garment hanger includes an upper garment support for a jacket or other upper body garment, a lower garment support for trousers or other lower body garment such as a skirt, and a hook for suspending the garment hanger on a transverse clothes rail.

When a garment or suit positioned on a conventional garment hanger has to be placed or removed from the clothes rail this often becomes difficult since access to a crowded clothes rails is typically hindered. It will be even more difficult for a person of normal height to hook the hanger over a high clothes rail, or for a person of short stature or with a disability to hook the hanger even on a conventional height rail, without tilting of the hanger, which may cause the trousers on the hanger to slide sideways and crumple, or to slip off the hanger.

Moreover, some conventional garment hangers are made with thin, wire like frames or far-too-flexible plastic. As a result, the weight of the clothes is distributed which or when lifted causes undue pressure on the hand, which often is at an uncomfortable angle.

The same inconvenience arises in other numerous quite different operations involving conventional garment hangers, such as transporting clothes on such a garment hanger, even for a short distance, demonstrating a suit to a customer in a shop, removing or placing a garment when several garments positioned on individual hangers are packed closely on the clothes rail, etc.

In other words, conventional garment hangers are simply not ergonomically suited to the structural and functional characteristics of human hand and arm, nor to the manner in which the hangers are used.

SUMMARY OF THE INVENTION

The present invention aims to address all of these deficiencies by providing a new, ergonomically improved garment hanger.

The present invention provides a garment hanger adapted for hooking over a clothes rail, including: a hanger frame for supporting a garment, said frame being generally perpendicular to a notional vertical plane containing said clothes rail; a hanger support hook adjacent an apex of the frame; and a handle portion depending downwards from an end of said frame, said end being offset downwardly from said apex and laterally of said notional vertical plane, said handle portion including a handle positioned for use by the user for handling the hanger.

Preferably said hanger frame includes a support arm extending from the apex of the frame to said end of the frame, and the handle portion depends downwards from a distal end of the support arm.

Preferably said handle portion depends downwards from a right-hand end of said frame.

Preferably said garment hanger further including orientation means for orientation of said clothes hanger relative to said clothes rail.

Preferably an opening of said hanger support hook faces away from the end of the frame having said handle.

Preferably said support arm is downwardly angled from the apex of the frame to the frame end.

In one embodiment, the hanger frame includes a generally horizontal garment rail adapted to support a lower body garment, and said handle is readily accessible by a user when the lower body garment is supported on the garment rail.

Preferably the hanger frame includes a generally horizontal garment rail adapted to support a lower body garment, the garment rail being supported by the support arm, and extending from a junction of the support arm and the handle portion.

In another embodiment the hanger frame includes a further support arm extending downwardly from the apex of the frame to an opposite end of the frame, and the support arms together are adapted to support an upper body garment.

In a further embodiment, the garment hanger includes a generally horizontal garment rail adapted to support a lower body garment, and the garment rail is supported by at least one of the support arms, and extends from a junction of said at least one support arm and the handle portion.

In one embodiment, the support arms include means for retention of straps of the upper body garment.

Preferably, said handle portion is sized and shaped to be received within the top of a sleeve of an upper body garment, such as a jacket, supported on the hanger frame.

Preferably, said handle portion, when received within said sleeve, does not cause substantial deformation of the sleeve.

Preferably said handle is readily accessible through the material of said sleeve.

In one embodiment, said garment hanger further includes a garment clip hinged relative to the hanger frame, being movable from a first position in which said garment clip cooperates with said generally horizontal garment rail to secure a lower body garment on said garment rail, and a second position in which said garment clip is moved away from said garment rail to permit the lower body garment to be placed or removed from said garment rail.

Preferably said garment clip includes resilient means for imposing a clamping force on said lower body garment, and adapted to compensate for variations in the thickness of lower body garments positioned on the garment rail.

Preferably said garment hanger further includes a retainer clip for holding said garment clip member in said second position.

In one embodiment said garment clip extends between a support arm of the frame and said generally horizontal garment rail.

In a preferred embodiment said garment clip includes first and second hinge members, said first hinge member being fixed to said support arm, said second hinge member being pivotally connected to said first hinge member for hinged movement between said first and second positions.

In one embodiment said support arms and said garment rail lie in substantially the same vertical plane.

In one form the hanger frame is a substantially triangular frame, optionally a closed triangular frame.

BRIEF DESCRIPTION OF THE DRAWINGS

Further preferred embodiments of the invention will now be described with reference to the drawings, in which.

DESCRIPTION OF THE PREFERRED EMBODIMENT

The garment hangers 10 in FIGS. 1-11 are each of the type based on two or more sides of a notional triangle, with a hook 14 for hooking onto a transverse clothes rail.

Referring now to the embodiment of the invention shown in FIGS. 1-6, the garment hanger 10 includes a substantially triangular hanger frame 11 which is generally perpendicular to a notional vertical plane 15*a* containing a clothes rail 15*b*, and a main hanger support hook 14 for supporting the hanger 10 on the clothes rail 15*b*.

Figure 1:
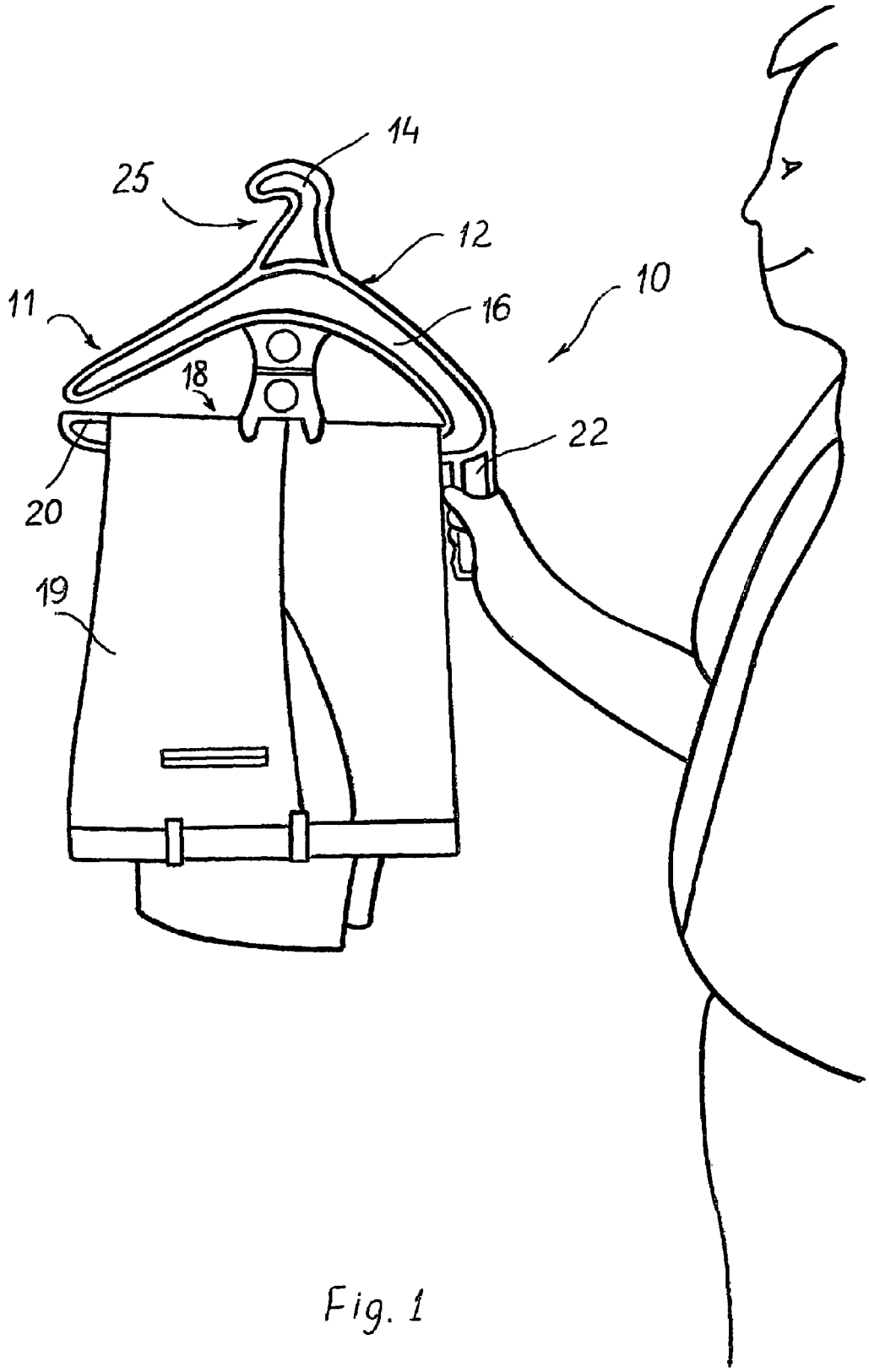
FIG. 1 is a perspective front view of a suit hanger according to a first embodiment of the present invention with trousers.
Figure 2:
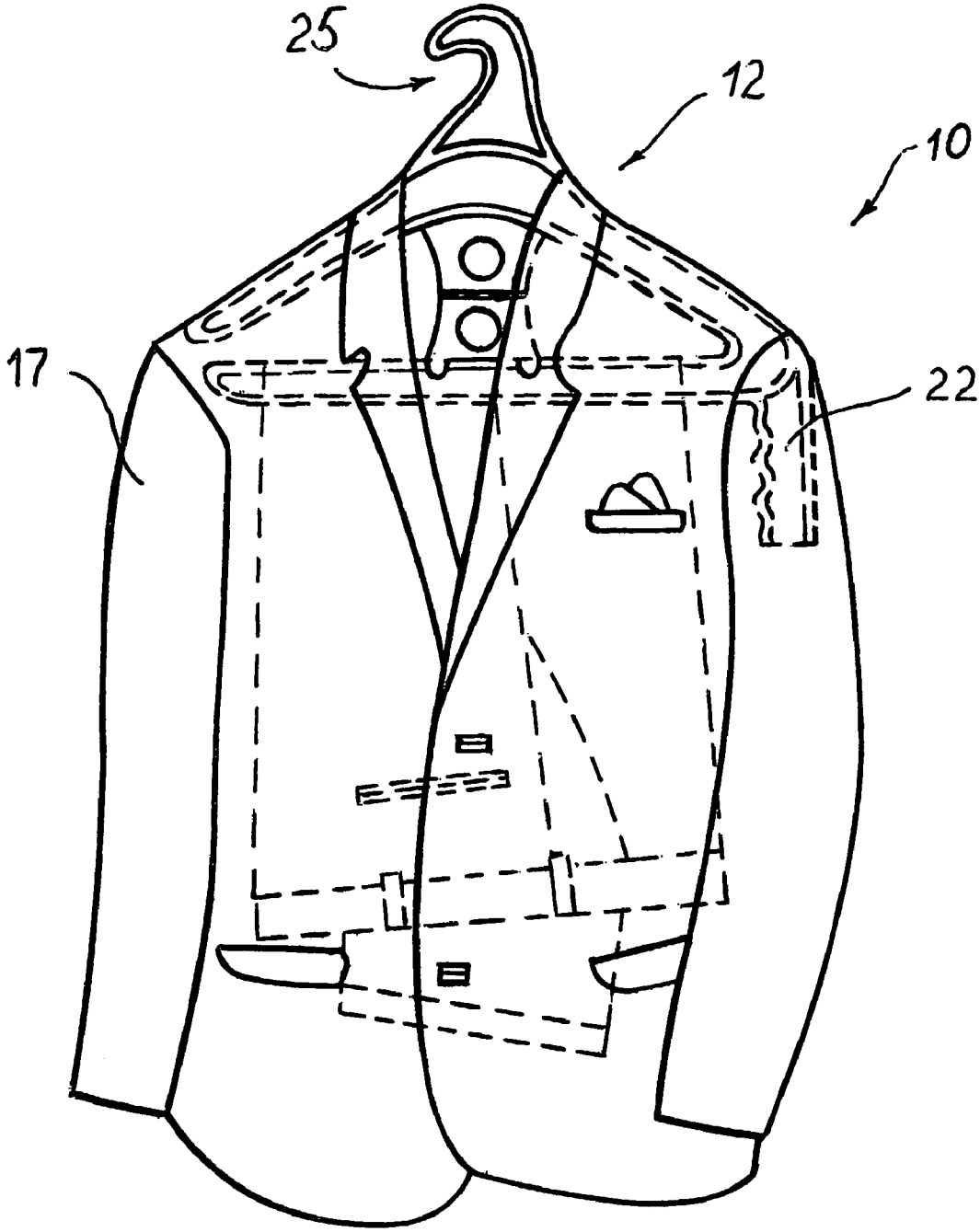
FIG. 2 is a perspective front view of the suit hanger of FIG. 1 with a jacket and trousers.

The frame 11 includes a jacket hanger portion 12 having a pair of shoulder-shaped, downwardly angled garment support arms 16 over which a jacket 17 shown in FIG. 2 can be positioned, and a trouser hanger portion 18 having a trouser support 20 over which trousers 19 shown in FIG. 1 have been positioned.

As shown clearly in FIGS. 1-3, the hanger unit 10 is provided with a handle 22, readily accessible to the user when the jacket 17 is on the hanger, for improved ease of handling and positioning of the hanger, as will be described in more detail later in this specification.

As shown in FIGS. 3-5*a*, the trouser hanger portion 18 includes a substantially horizontal garment rail 20 for supporting trousers. Preferably, the garment rail 20 is cantilevered from the lower end of the support arm 16, so that the other side of the trouser hanger portion presents an open recess for easier positioning of the trousers on the rail 20.

Figure 12:
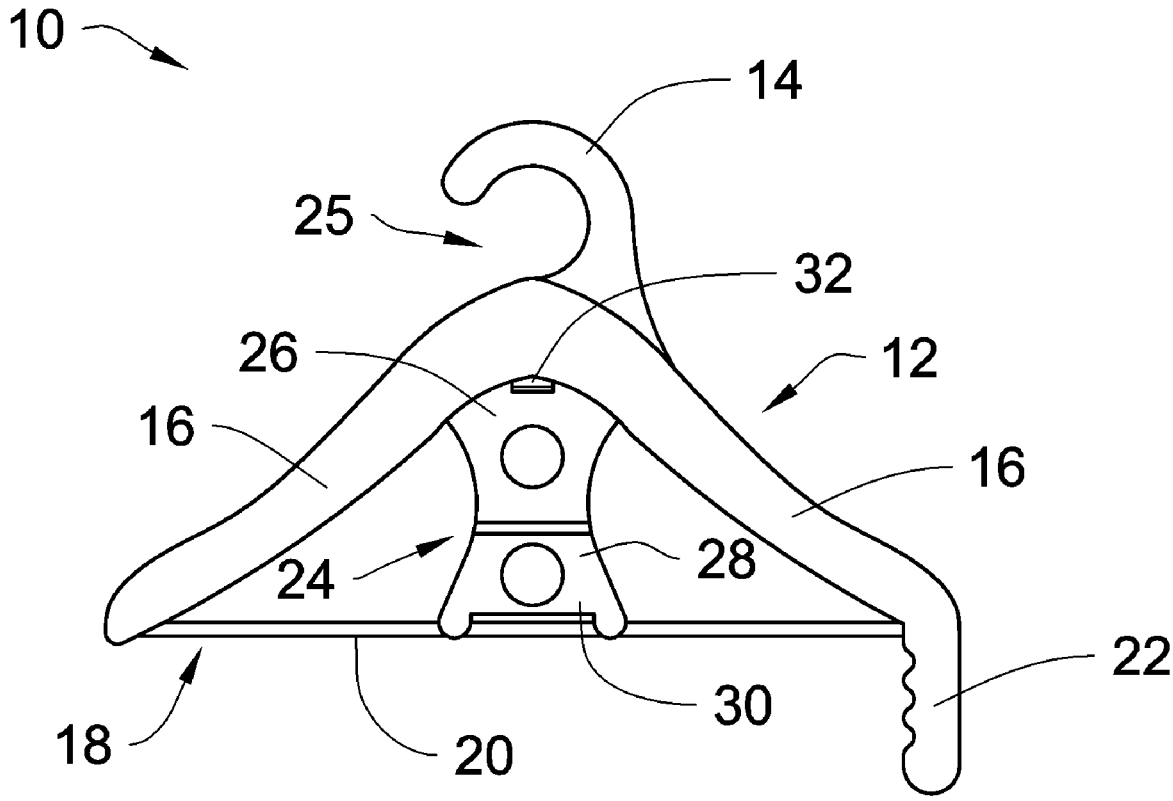
FIG. 12 is a front elevation of a closed triangular frame of the present invention.

Alternatively, the rail 20 may be connected to both support arms 16 to form a strong, closed triangular frame, as illustrated in FIG. 12.

In FIGS. 3-5*b*, both the support arms and trouser rail are formed as a generally I-shaped section, with edge flanges providing stiffness and a support surface for garments.

The handle 22 extends down from the junction of the support arm 16 and the rail 20 at the end of the hanger frame opposite that faced by the hook opening 25, providing a far more convenient means for the user to position the hanger onto, or remove the hanger from, the clothes rail 15*b* without undue tilting of the hanger.

As best seen in FIG. 2, the handle 22 is sized and shaped to be received within the top of the sleeve of the jacket 17 hanging freely from the jacket hanger portion 12 when the garment hanger is suspended from the clothes rail 15*b*. Preferably, the size, shape and placement of the handle 22 are such that the handle causes little or no deformation of the sleeve. Preferably, the handle 22 is readily accessible through the material of the sleeve. Preferably, the length of the handle is such that the handle fits freely into an arm hole of the jacket.

Figure 3:
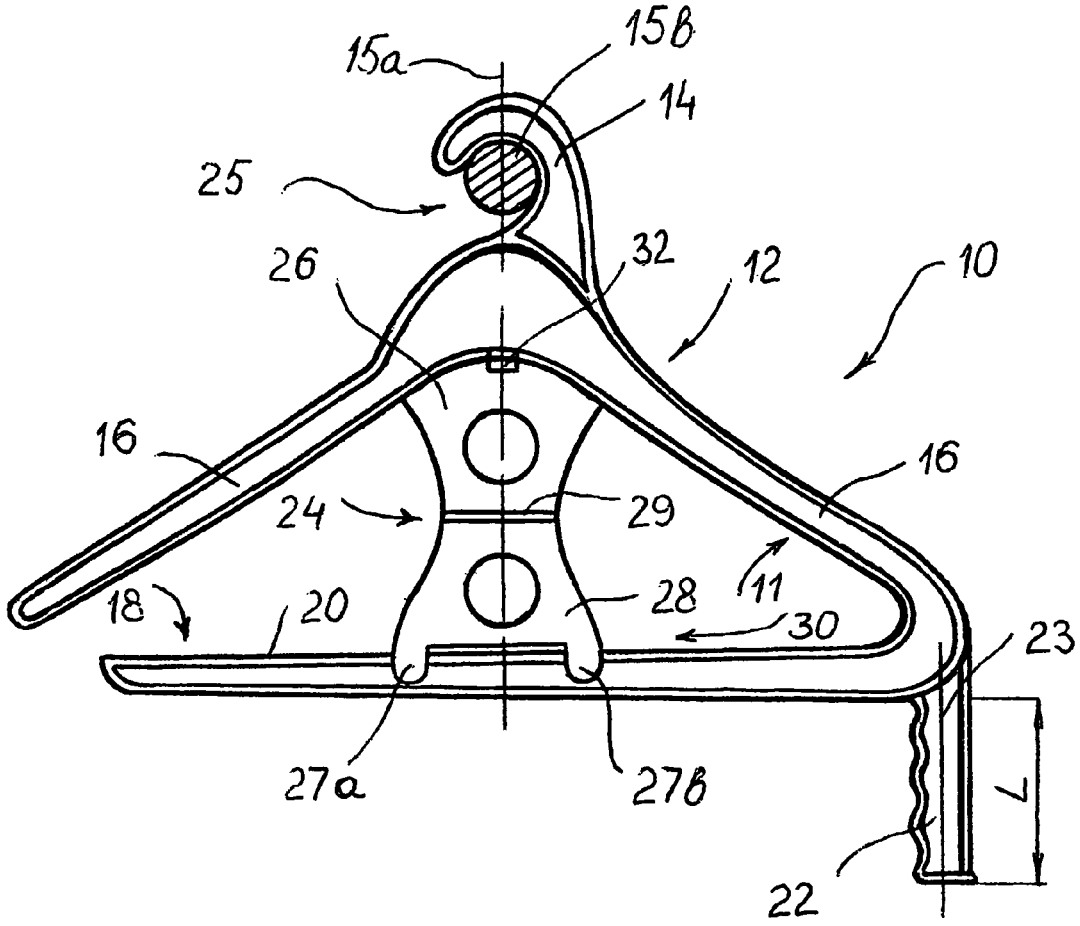
FIG. 3 is a front elevation of the hanger shown in FIG. 1.
Figure 4:
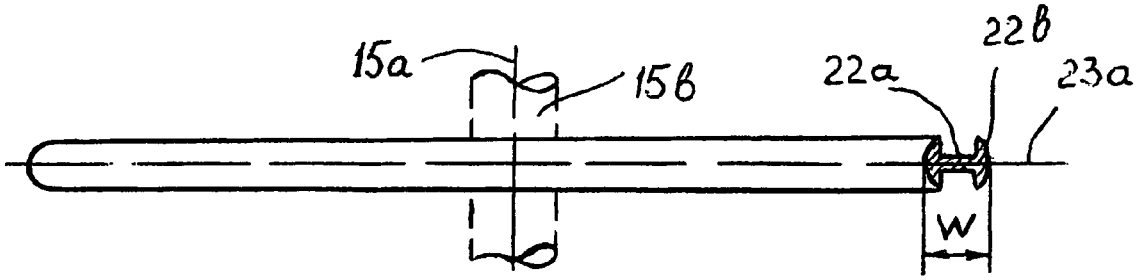
FIG. 4 is a plan view of the hanger shown in FIG. 1.

In a preferred embodiment the handle 22 is straight and longitudinally oriented along a substantially vertical axis 23 (refer to FIG. 3). The handle could also be angled, curved or contoured so long as it can be conveniently grasped by a human hand. The handle shown has a substantially flat I-beam shaped cross-section formed by a web 22*a* and a pair of end flanges 22*b*, though many other cross-sections are possible.

In a preferred embodiment the handle has a length L of about 10 cm and a width W of about 2.5 cm. The width of the web 22*a* is about 0.5 cm measured perpendicular to plane 23*a*. Preferably, the end flanges 22*b* have arcuate shaped external surfaces thereby allowing a user to hold the garment hanger by hand with ease and comfort.

The handle 22 may be moulded into either the left or the right bottom end corner of rail 20, allowing ready access to and operation of the handle when both upper and lower garments are on the hanger. Preferably, however, the handle is in the right hand corner of the hanger frame to suit the 90% of the population which is right-handed. In this way, the position of the handle may be predicted even when obscured by the jacket sleeve. Furthermore, this will help consistent orientation of the hangers on the rail so as to take up less room.

As best seen in FIG. 3, the garment hanger further includes a hinged trouser retention clip construction 24 having first 26 and second 28 hinge members connected along a hinge line 29. The first hinge member 26 is fixed to the support arm 16. The second hinge member 28 is a hinge flap provided with a clip member 30.

Figure 5A:
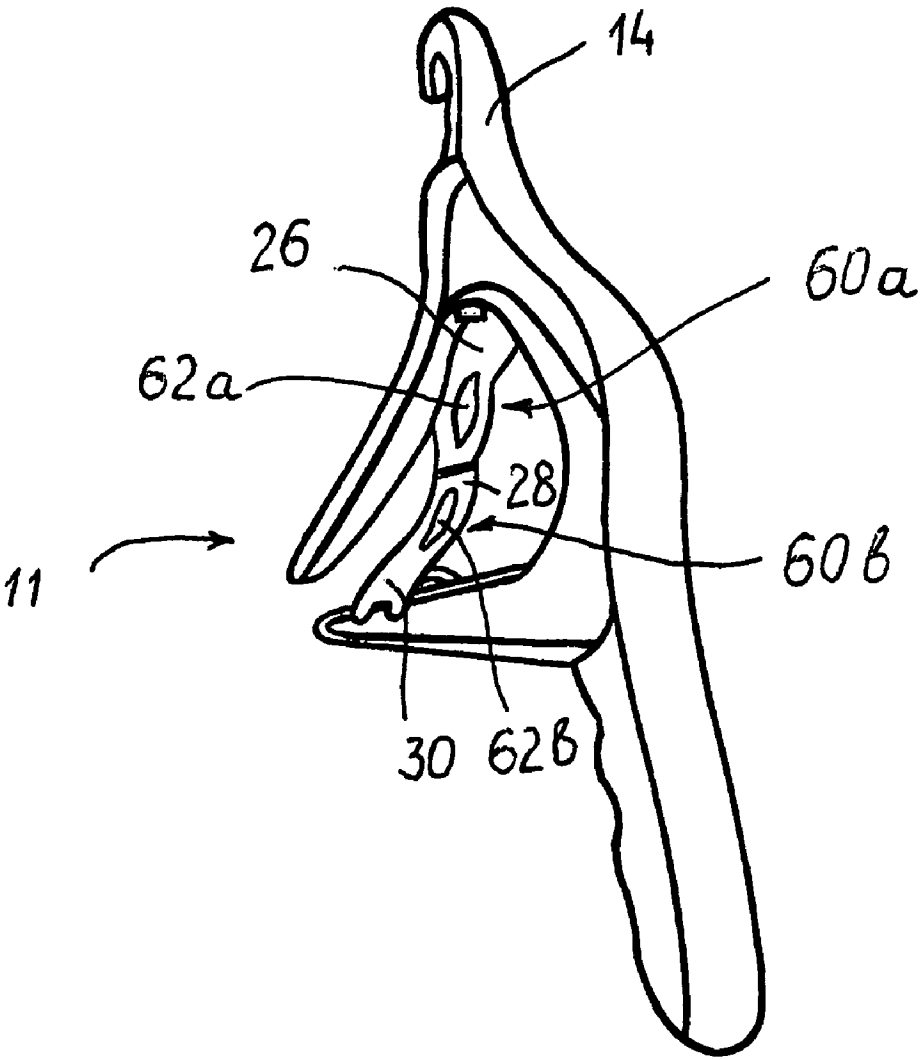
FIG. 5*a* is a perspective side view of the suit hanger of FIG. 1 with the clip closed.
Figure 5B:
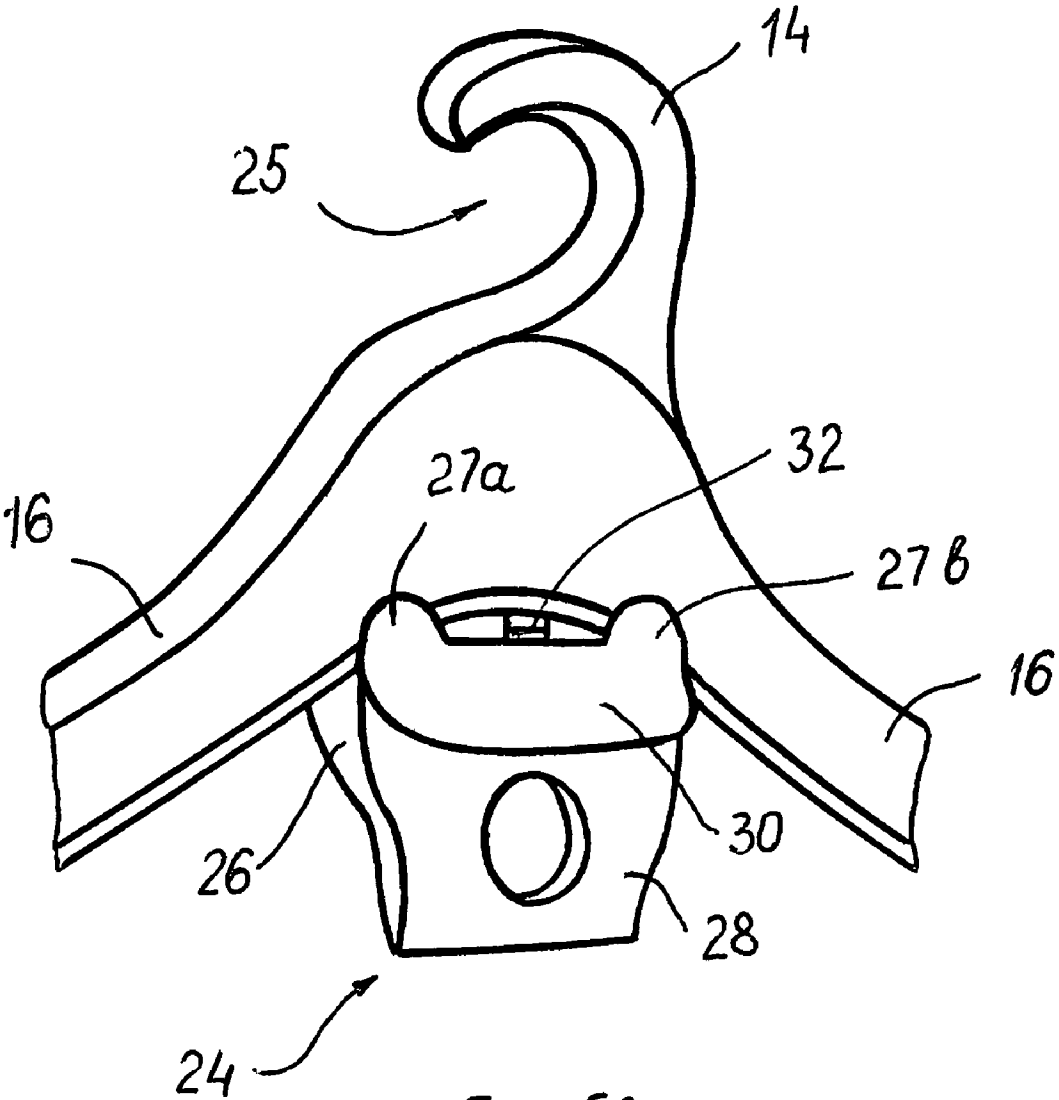
FIG. 5*b* is a perspective detail view of the suit hanger of FIG. 1 with the clip open.

Referring to FIGS. 5*a* and 5*b*, the first and second hinge members 26 and 28 are pivotally connected to one another for hinged movement between a first position (FIG. 5*a*) in which the clip member 30 cooperates with the garment rail 20 to secure trousers on the garment rail, and a second position (FIG. 5*b*) in which the flap 28 is moved away from the garment rail 20 to permit the trousers to be placed or removed from the garment rail. The lugs 27*a* and 27*b* act as stop tabs to keep the flap 28 from hinging beyond the first position.

The garment hanger further includes a retainer clip 32 located on the support arm 16 for holding the flap 28 in the second position. Alternatively, a compound hinge including two spaced pivotally supported hinge elements may be used for the purpose of holding the clip 30 in the open position.

In a preferred embodiment the hinge construction 24 is resiliently flexible to apply a clamping force, via the clip 30, to the trousers on the garment rail 20. Such resilience helps to compensate for variations in the thickness of the lower body garment positioned on the garment rail 20, thereby enabling the hanger 10 to be used for a wide range of lower body garments.

Any suitable resilient means may be employed for this purpose. In particular, the hinge members 26 and 28, or the clip 30, or both, may be formed of a resilient material. Also, the hinge construction 24 may include any suitable shape configurations which are capable of being deformed to a limited extent. In the embodiment shown in FIGS. 5*a* and 5*b* each hinge member 26 and 28 includes a curved portion 60*a* (60*b*), optionally weakened by a hole 62*a* (62*b*) for this purpose.

The trouser support portion 18 and the hinge construction 24 are preferably integrally moulded with the jacket support portion 12 from a plastics material such as polypropylene. Alternatively, the trouser support portion 18 and/or the hinge construction 24 may be manufactured separately from the jacket support portion 12 and then subsequently connected to the jacket support portion during a succeeding manufacturing step.

It should be noted that the trouser hanger with handle is a useful and inventive item in its own right, separately of the jacket hanger, and forms a separate embodiment of the present invention.

Figure 6:
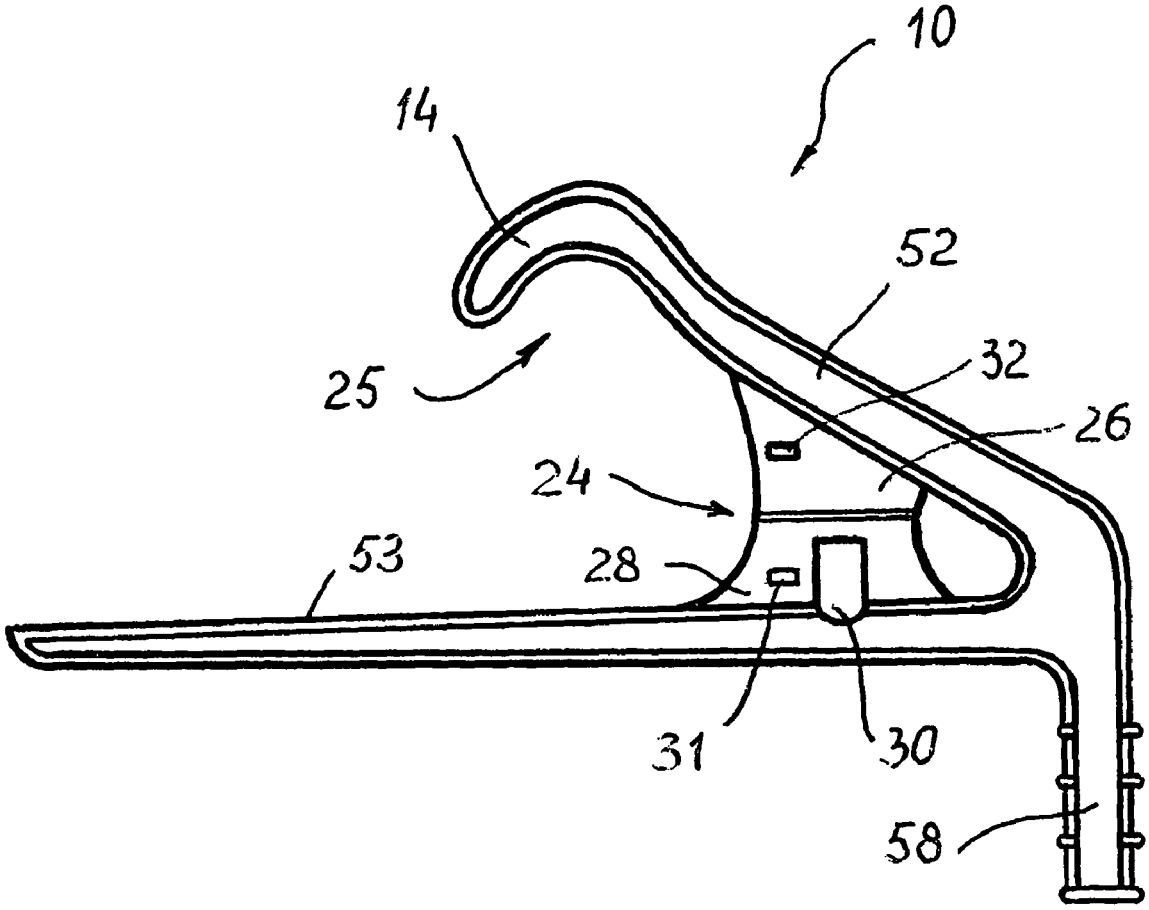
FIG. 6 is a front elevation of a trouser hanger according to a second embodiment of the present invention.
Figure 7:
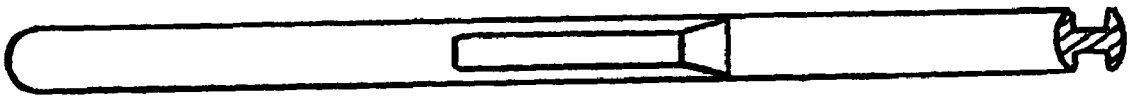
FIG. 7 is a plan view of the hanger shown in FIG. 6.
Figure 8:
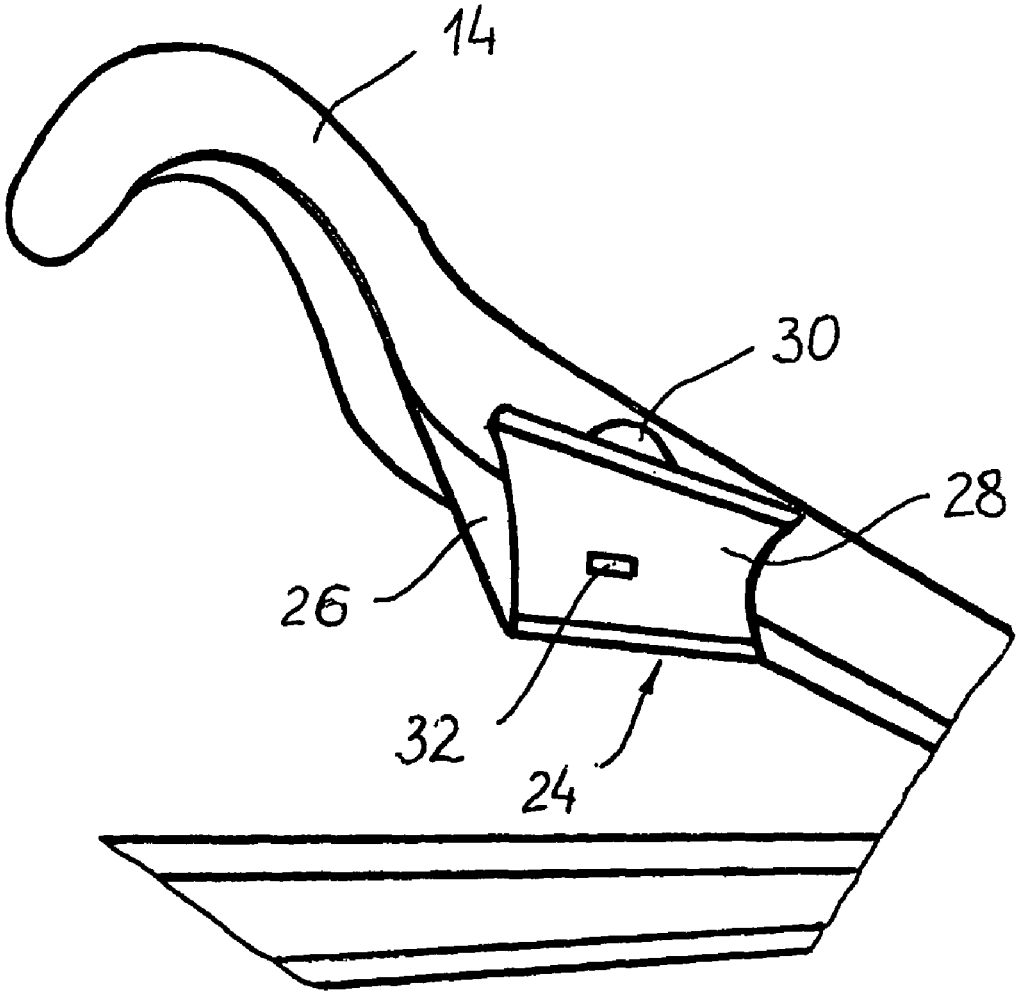
FIG. 8 is a perspective detail view of the suit hanger of FIG. 6 with the clip open.

There is illustrated in FIGS. 6-8 a trouser hanger 10 embodying the present invention. The trouser hanger 10 includes a single downwardly-angled support arm 52, a generally horizontal rail 53, supported by the support arm 52, a hanger support hook 14, and a handle 58 extending downwards from the junction of the support arm 52 and the rail 53.

In one embodiment, the trouser hanger 10 further includes the integral hinge 24 already discussed above in relation to FIGS. 1-5*b*. The hinge 24 includes a projection 32 located on the flap 26 which will engage with a matching opening 31 located on the flap 28 when the flap 28 is lifted, to hold the hinge 24 out of the way while the trousers are being positioned on the garment rail 53. Alternatively, a compound hinge construction may be used for this purpose.

Figure 9:
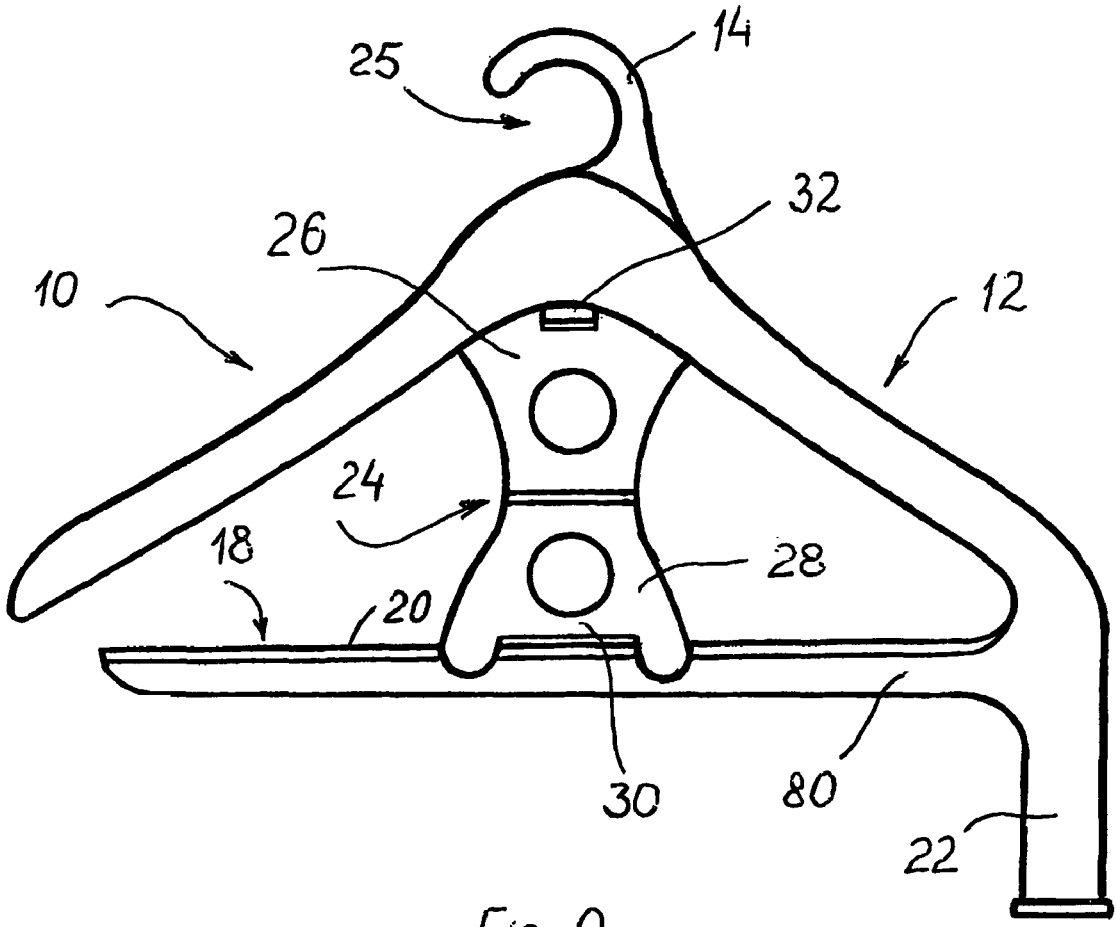
FIG. 9 is a front elevation of a trouser hanger according to a third embodiment of the present invention.
Figure 10:
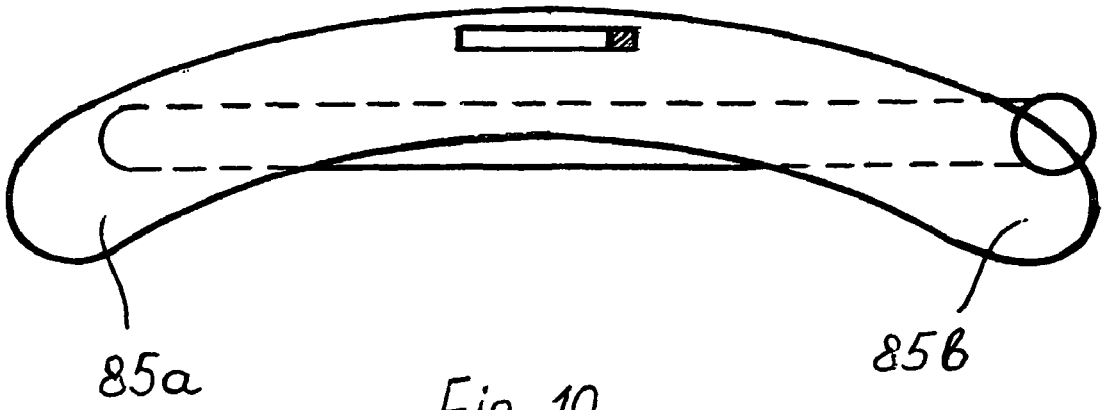
FIG. 10 is a plan view of the hanger shown in FIG. 9.
Figure 11:
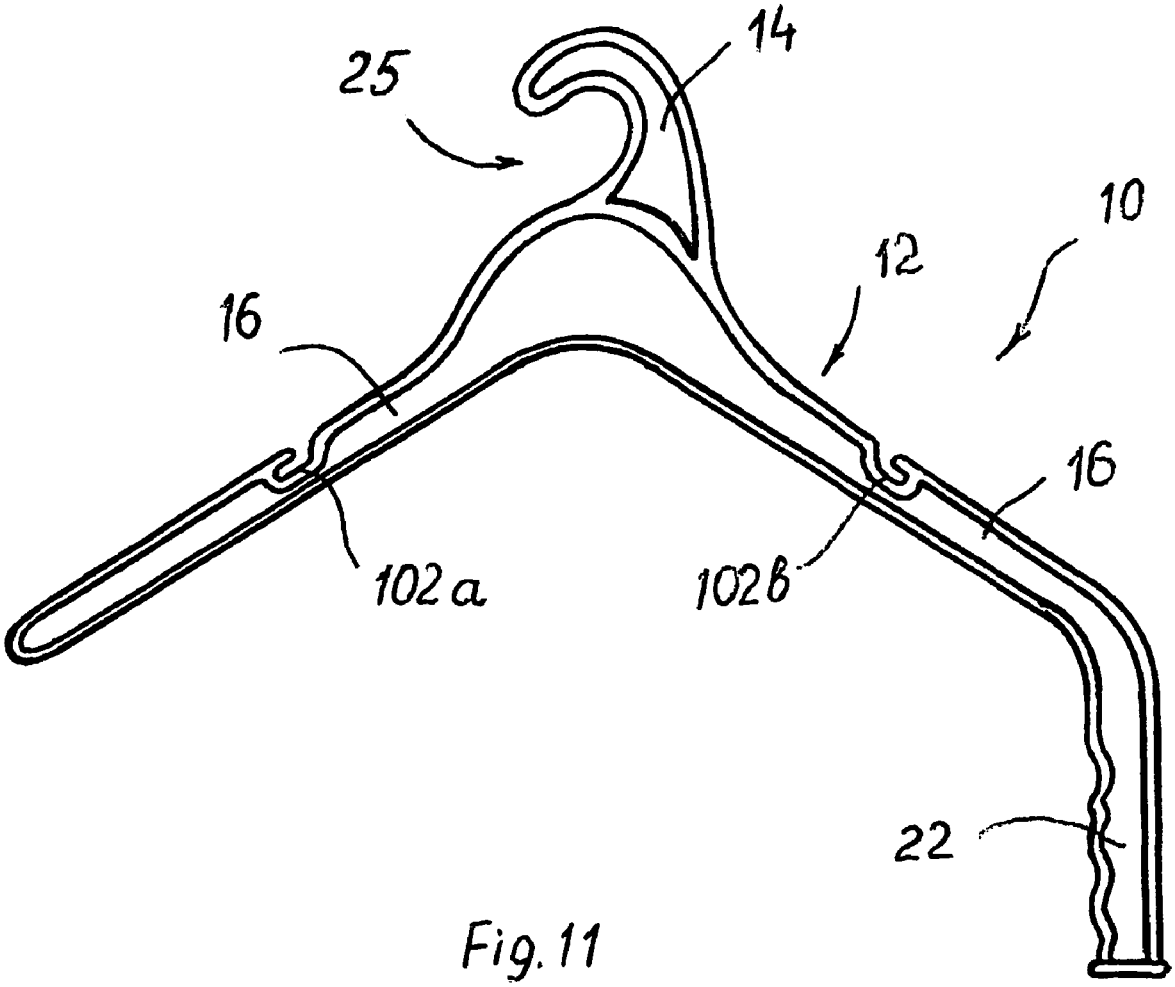
FIG. 11 is a front elevation of a suit hanger according to a fourth embodiment of the present invention.

As shown in FIGS. 9 and 10, the construction of the present invention is adapted also to manufacture of premium suit hangers with a contoured jacket support. As can be seen from FIG. 10, the jacket hanger portion includes a pair of broad, forwardly-curved jacket support arms 85*a* and 85*b* for hanging a jacket, while the trouser support portion 80 has a substantially straight, planar construction. The support arms 85*a* and 85*b*, and 10 and 12 have an inverted U-shaped cross-section. Members 10 and 18 may also be fully connected FIG. 11 shows an alternative embodiment of the present invention. In this embodiment the garment hanger includes a pair of upper garment support arms 16. Each arm 16 can be provided with a notch 102*a* (102*b*) for retention of clothes with straps, as is known in the art. Other known accessories/modifications may also be included.

The handle located at the bottom end corner of the hanger allows convenient positioning of the hanger onto a high clothes rail without having to unduly tilt the hanger, and importantly will be of significant benefit to the disabled or those of short stature, who otherwise may have trouble reaching a clothes rail of standard height. The handle configuration described and illustrated herein will provide an additional reach of up to approximately 250 mm, which means that a conventional clothes rail will be able to be positioned about 250 mm higher and that in many instances a second clothes rail may then be able to be provided underneath. This will be of particular benefit to clothing retailers and residential and hotel wardrobe designers, who can therefore make effective use of the extra available storage space.

The handles, being positioned along the front of the wardrobe, make it easier to have access to the garments in the wardrobe.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein. For example, the jacket and trouser hangers described herein are each useful items in their own right and each of these, as separate articles, is intended to be covered by the spirit and scope of the present invention. It will further be understood that any reference herein to known prior art does not, unless the contrary indication appears, constitute an admission that such prior art is commonly known by those skilled in the art to which the invention relates.

The invention claimed is:

1. A garment hanger adapted for hooking over a wardrobe clothes rail or a hook in a wall, including:

a hanger frame for supporting a garment, said frame being generally perpendicular to a notional vertical plane containing said clothes rail, a hanger support hook adjacent an apex of the frame, at least one support arm extending from said apex, and a handle portion depending downwards from a distal end of said support arm, said end being offset downwardly from said apex and laterally of said notional vertical plane, said handle portion including a handle positioned substantially directly below said end of said support arm for use by a user for handling the hanger, wherein said hanger frame includes a generally horizontal garment rail adapted to support a lower body garments said garment rail being supported by said at least one support arm, and extending from a junction of said at least one support arm and said handle portion;

wherein said garment hanger further comprising a garment clip hinged relative to said hanger frame, said garment clip being movable from a first position in which said garment clip cooperates with said generally horizontal garment rail to secure a lower body garment on said garment rail, and a second position in which said garment clip is moved away from said garment rail to permit the lower body garment to be placed or removed from said garment rail.

2. The garment hanger according to claim 1 wherein said support arm is downwardly angled from said apex to said frame end.

3. The garment hanger according to claim 1 wherein said frame includes a generally horizontal garment rail adapted to support a lower body garment, and wherein said handle is readily accessible by a user when said lower body garment is supported on said garment rail.

4. The garment hanger according to claim 1 wherein said frame includes a further support arm extending downwardly from said apex to an opposite end of said hanger frame, and wherein said support arms together are adapted to support an upper body garment.

5. The garment hanger according to claim 4 further including a generally horizontal garment rail adapted to support a lower body garment, said garment rail being supported by at least one of said support arms, and extending from a junction of said at least one support arm and said handle portion, and wherein said handle is readily accessible by a user when said lower body garment is supported on said rail.

6. The garment hanger according to claim 4 or 5 wherein said support arms include means for retention of straps of said upper body garment.

7. The garment hanger according to claim 1 wherein said handle portion is sized and shaped to be received within the top of a sleeve of an upper body garment supported on said hanger frame.

8. The garment hanger according to claim 7 wherein said handle portion, when received within said sleeve, does not cause substantial deformation of said sleeve.

9. The garment hanger according to claim 7 wherein said handle is readily accessible through the material of said sleeve.

10. The garment hanger according to claim 1 further including a retainer clip for holding said garment clip in said second position.

11. The garment hanger according to claim 1 wherein said garment clip extends between a support arm of said frame and said generally horizontal garment rail.

12. The garment hanger according to claim 1 wherein said garment clip includes resilient means for imposing a clamping force on said lower body garment, and adapted to compensate for variations in the thickness of lower body garments positioned on the garment rail.

13. The garment hanger according to claim 11 wherein said garment clip includes a first and second hinge members, said first hinge member being fixed to said support arm, said second hinge member being pivotally connected to said first hinge member for hinged movement between said first and second positions.

14. The garment hanger according to claim 1 wherein said clip member includes a lug for keeping the garment clip from hinging beyond said first position.

15. The garment hanger according to claim 5 wherein said support arms and said garment rail lie in substantially the same vertical plane.

16. The garment hanger according to claim 1 wherein said frame is a substantially triangular frame.

17. The garment hanger according to claim 1 wherein said frame is a closed triangular frame.

18. The garment hanger according to claim 1 further including means for orientation of said clothes hanger relative to said clothes rail.

19. The garment hanger according to claim 1 wherein an opening of said hanger support hook faces away from the end of the frame having said handle.

20. The garment hanger according to claim 1 wherein said handle depends downwards from a right-hand end of said frame.

21. The garment hanger according to claim 1 wherein said handle portion is coupled to said frame such that the user can grasp said garment hanger.

22. The garment hanger according to claim 1 wherein said hanger frame is supported from said handle in a cantilever fashion.

* * * * *